US009248332B2

(12) United States Patent
Dennis et al.

(10) Patent No.: US 9,248,332 B2
(45) Date of Patent: Feb. 2, 2016

(54) EXERCISE APPARATUS, METHODS OF USING, AND METHOD OF MANUFACTURE

(76) Inventors: Douglas S. Dennis, Loveland, OH (US); David W. Frey, Loveland, OH (US)

( * ) Notice: Subject to any disclaimer, the term of this patent is extended or adjusted under 35 U.S.C. 154(b) by 486 days.

(21) Appl. No.: 13/354,306

(22) Filed: Jan. 19, 2012

(65) Prior Publication Data

US 2012/0264577 A1 Oct. 18, 2012

Related U.S. Application Data

(60) Provisional application No. 61/475,637, filed on Apr. 14, 2011.

(51) Int. Cl.

| | |
|---|---|
| ***A63B 21/02*** | (2006.01) |
| ***A63B 21/055*** | (2006.01) |
| ***A63B 21/00*** | (2006.01) |
| ***A63B 23/12*** | (2006.01) |

(52) U.S. Cl.

CPC ..... *A63B 21/0557* (2013.01); *A63B 21/00043* (2013.01); *A63B 21/1469* (2013.01); *A63B 23/1245* (2013.01)

(58) Field of Classification Search

USPC ..... 482/126, 127, 140; D21/198, 693

See application file for complete search history.

(56) References Cited

U.S. PATENT DOCUMENTS

| | | | | |
|---|---|---|---|---|
| 2,132,862 | A | | 10/1938 | Pilates |
| 2,529,347 | A | | 11/1950 | Mohler et al. |
| 2,725,232 | A | | 11/1955 | Magida |
| 2,806,699 | A | | 9/1957 | Spooner |
| 3,349,621 | A | | 10/1967 | Mullen |
| 4,210,323 | A | * | 7/1980 | Feather ..... A63B 21/0004 482/122 |
| 4,374,588 | A | | 2/1983 | Ruggles |
| D277,593 | S | | 2/1985 | Terrian et al. |
| 4,629,186 | A | * | 12/1986 | Aldridge ..... 482/126 |
| 4,733,861 | A | | 3/1988 | Plunkett, III |
| D322,827 | S | | 12/1991 | Bennstrom et al. |
| D346,632 | S | | 5/1994 | Castellanos |
| 5,399,138 | A | | 3/1995 | Jones |
| 5,496,245 | A | * | 3/1996 | Du Verney ..... A63B 21/0004 482/121 |
| 5,626,545 | A | * | 5/1997 | Newman et al. ..... 482/127 |
| 5,634,874 | A | | 6/1997 | Kest et al. |
| 5,674,164 | A | | 10/1997 | Kravitz |
| 5,690,596 | A | * | 11/1997 | Parker ..... 482/126 |
| 6,024,679 | A | * | 2/2000 | Castallanos et al. ..... 482/140 |
| 7,008,354 | B2 | | 3/2006 | Wen |
| 7,789,815 | B2 | | 9/2010 | An |
| 2007/0066459 | A1 | | 3/2007 | Lemmex |

* cited by examiner

*Primary Examiner* — Stephen Crow
*Assistant Examiner* — Andrew S Lo
(74) *Attorney, Agent, or Firm* — Wood, Herron & Evans, L.L.P.

(57) ABSTRACT

A variable resistance-type exerciser has pivotally interconnected arms with a longer pair of padded handle forming ends and a shorter pair of padded handle forming ends. An elastomeric band is interchangeably fitted to the arms through integral slots in each arm forcing the longer handles apart and the shorter handles together. The elastomeric band can easily be replaced or additional bands added to vary the resistance and resulting weight bearing equivalent load of the device. A pin interconnects the arms forming a device that pivots about an axis perpendicular to the plane of the device and in such a fashion as to allow for pushing and/or pulling motions. The exerciser is used by pushing or pulling the longer ends toward one another and/or by pushing or pulling the shorter ends apart. A multitude of exercises results from applying the above described motions to various upper or lower body muscle groups.

20 Claims, 3 Drawing Sheets

EXERCISE APPARATUS, METHODS OF USING, AND METHOD OF MANUFACTURE

DATA SOURCES

This application claims the benefit of U.S. Provisional Patent Application No. 61/457,637, filed Apr. 14, 2011, which is incorporated by reference herein in its entirety.

TECHNICAL FIELD

This disclosure relates to the use of exercise equipment and, more particularly, to the use of lightweight portable exercise devices, which provide numerous versatile exercises that target a multiplicity of muscle groups within either the upper or lower body.

BACKGROUND ART

The present invention is in the technical field of exercise. More particularly, the present invention is in the technical field of exercise devices. More particularly, the present invention is in the technical field of lightweight, portable exercise devices.

Conventional exercise devices, such as weights including those of the type of bar bells and dumb bells, stationary exercise machines of either weight bearing or other forms of mechanical or other resistance in nature and the like, are typically either immovable or exceedingly difficult to transport. It is difficult to use these devices in a house, office, or facility outside of a traditional gym because they are large and heavy. Moving such devices typically requires several strong persons, or a sturdy wheeled vehicle such as a reinforced wagon or handcart. The difficulties of bringing such a device into a house or office are multiplied when stairs must be climbed. Further, it is not an uncommon desire to afford such exercise devices as portable rendering them capable of transport on a trip or excursion. Devices as those described, which are heavy and bulky in nature, do not lend themselves to the concept of portability and transport for a journey or use outside of the gym.

Further, exercise devices as heretofore described are most often developed to train specific muscle groups requiring a multiplicity of devices to exercise the entire muscular system of the human body. Such devices are dedicated in task to exercising limited muscle groups requiring unique devices to be maintained for the purpose of providing whole body workout routines. Such equipment is not only numerous due to exercise specificity; but, by nature it is bulky and requires significant space for setup and use, rendering them inappropriate to compact, portable use.

It is in the simplicity of this invention that makes it novel. It is lightweight, portable and versatile in its application rendering it ideal for transport and use both in the home, on trips, and at other locations outside of the traditional gym. The uniqueness of the device also renders the need for heavy, dedicated workout devices unnecessary, eliminating the need for multiple, complex workout equipment in the exercise of the whole body including multiple muscle groups.

SUMMARY OF INVENTION

The present invention is an exercise device for users that is compact, lightweight and portable. Current devices are either too complicated to manufacture, too limited in the number and quality of exercises that can be performed with them, or both. This device has been designed to be very simple and cost-effective to manufacture, to be extremely portable and usable by the widest variety of people, from senior citizens to body builders and athletes. This invention allows a person to perform numerous exercises with varying degrees of resistance, is fully self-contained, and extremely lightweight and portable.

DETAILED DESCRIPTION OF THE INVENTION

Figure 1:
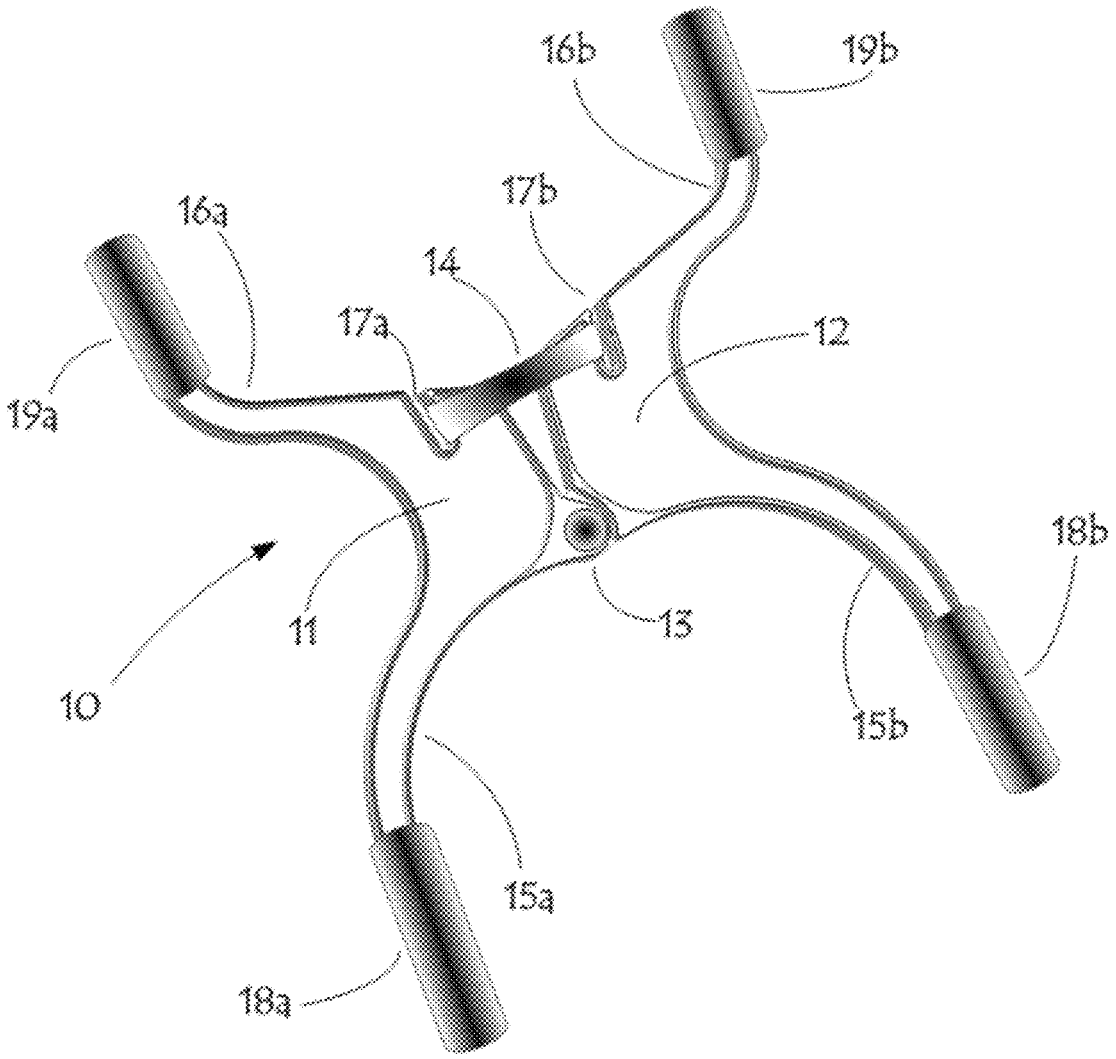
FIG. 1 is a perspective view of an exercise device of the present invention.

Referring now to the invention in more detail, in FIG. 1 is shown an exercise device 10 comprised of two arms 11 and 12 secured in the center through a slot FIG. 3-36 by pin halves 33 and 34 allowing arms 11 and 12 to pivot about this connection point 13 and in the plane of the two arms. The resulting device configuration being comprised of an upper half of two (2) shorter handles 16*a* and 16*b* fitted with padded rubber grips 19*a* and 19*b* respectively and a lower half of two (2) longer handles 15*a* and 15*b* fitted with padded rubber grips 18*a* and 18*b* respectively. A resistance band 14 of a type of an elastomeric or other resistive material is replaceably fitted into the slots 17*a* and 17*b* in the arms causing the shorter ends of the arms 16*a* and 16*b* to be drawn toward one another, and the longer ends of the arms 15*a* and 15*b* to be forced apart from one another.

Figure 2:
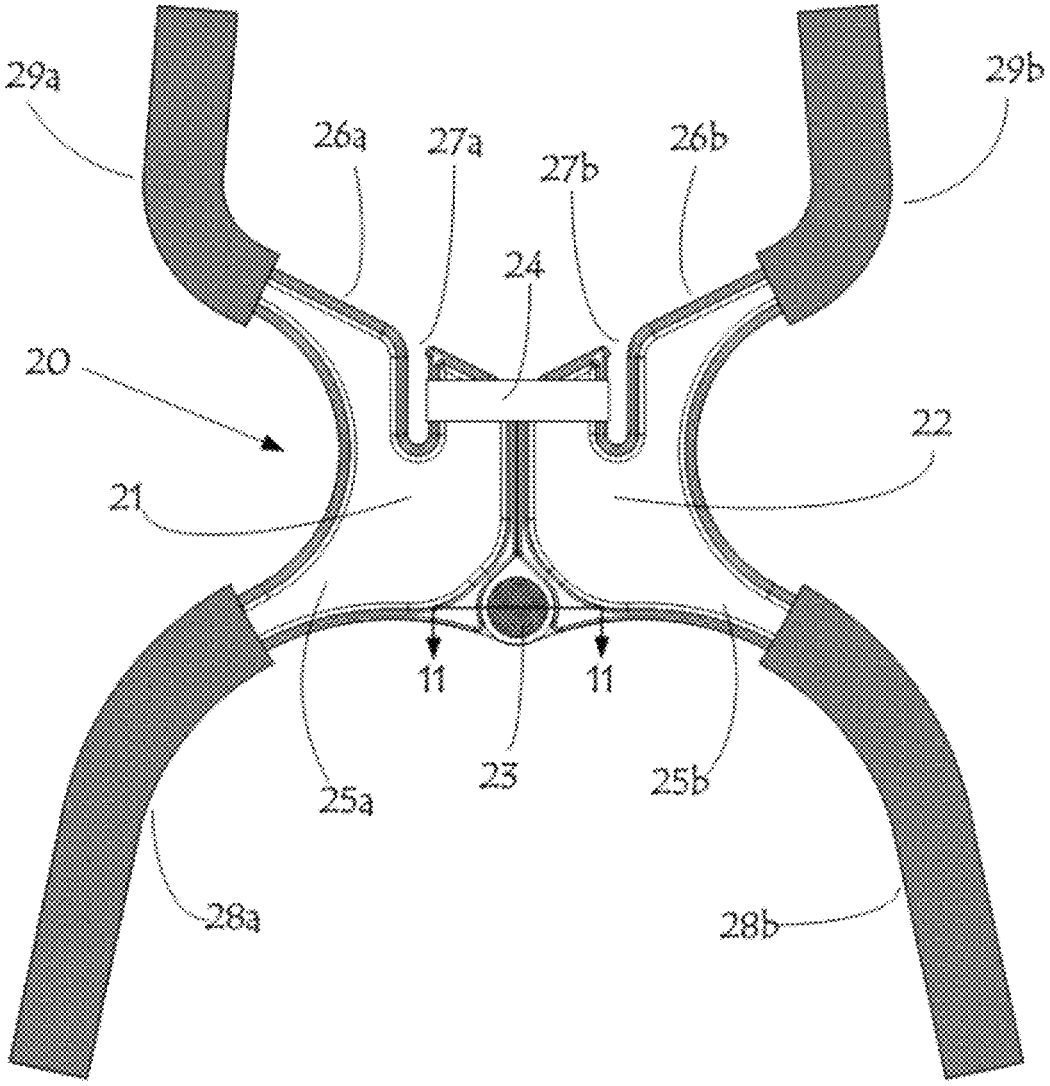
FIG. 2 is a side view of an exercise device of FIG. 1.

In more detail, and now referring to the invention of FIG. 2, the exerciser 20 as shown includes two arms 21 and 22 each having a shorter end 26*a* and 26*b* and a longer end 25*a* and 25*b*. Notably, the shorter ends of the arms 26*a* and 26*b* are fitted with padded material 29*a* and 29*b* to provide comfortable grips and to add a friction surface to the device. In a similar manner, the longer ends of the arms, 25*a* and 25*b*, are also equipped with similar padding 28*a* and 28*b* for the same purpose of providing comfort and a friction like surface.

In further detail, the arms 21 and 22, having been joined through the central slot FIGS. 3-36 with a pin comprised of pin halves 33 and 34, can now pivot about this joint 23 freely. A replaceable band of elastic material 24 is fitted in slots 27*a* and 27*b* in such a fashion as to cause the band 24 to be placed in tension. The tension in band 24 causes the ends of arms 21 and 22 namely 26*a* and 26*b* to be drawn toward one another while at the same time causing the opposite ends of the arms namely 25*a* and 25*b* to be forced apart from one another. The tension in band 24, or a plethora of such bands similarly configured, provides the resistance against which exercise is performed. Tension and thus the resistance against which exercise is performed can be controlled by adding multiple bands 24 or by adding bands of varying tension, weight, and alternate materials allowing the device to be used for a variety of exercises and with any number of resistance factors. In an alternative embodiment, one or more replaceable bands of elastic material 24 may be attached to the exercise device 10 through hooks or other suitable methods of attaching the band 24 to the device 10.

In its resting or static state, the device is maintained in a closed configuration by tension in the elastic band FIG. 2-24 resulting in the upper, shorter, more closely spaced arms namely 26*a* and 26*b* being forced together and the lower, longer, less closely spaced arms namely 25*a* and 25*b* being forced apart. From this configuration and using the resistance within the device caused by the elastic band, results in exercises of a nature where the upper, shorter arms are pulled apart against the resistance or the lower, longer arms are pushed together against the resistance.

Figure 3:
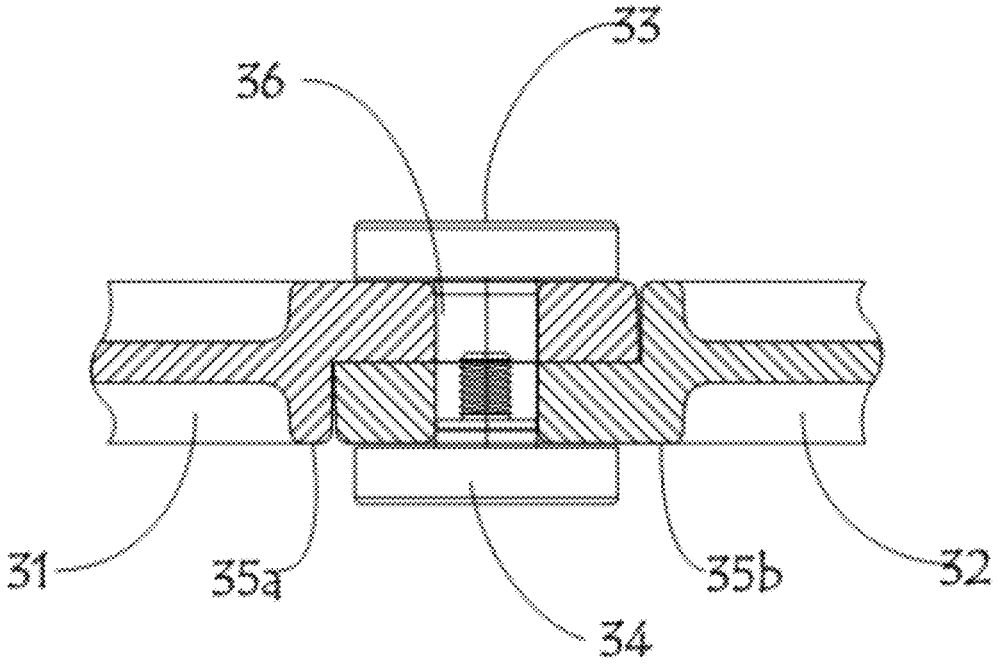
FIG. 3 is a section view of the exercise device of FIG. 1 taken along line 3-3 detailing the pivotal joining mechanism.

The construction details of the invention as shown in the section view of FIG. 3 depict arms 31 and 32 joined by pin halves 33 and 34 through slot 36. This connection forms a frictionless joint about which arms 31 and 32 pivot on bearing sections 35*a* and 35*b*. The device provides lateral movement about this pivot point of the joint providing both push and pull resistance exercises. When the exercise device is equipped with a resistance band as described, exercises requiring a pushing or compressing movement can be accomplished using the longer ends of the arms FIGS. 1-15*a* and 15*b* while exercises requiring an extension or pulling motion can be accomplished using the shorter ends of the arms FIGS. 1-16*a* and 16*b*.

Alternatively, it will be appreciated that the location of the slots 17*a* and 17*b* and the resistance band 14 could be changed to the opposite side of the pin halves 33 and 34 so that the resistance band 14 causes the device 10 to maintain a closed condition with the longer arms 25*a* and 25*b* being forced together and the shorter arms 26*a* and 26*b* being forced apart. In yet another alternative embodiment, it will be appreciated that the locations of the longer arms 25*a* and 25*b* and the shorter arms 26*a* and 26*b* could be reversed. In each of these alternative embodiments, exercises are provided of a nature where the upper, shorter arms are pushed together against the resistance and the lower, longer arms are pulled apart against the resistance.

Using the exercise device 10 of the present invention, a user may perform one or more of the following exercises:

the user holds the exerciser with outstretched arms, and presses or pulls either set of the first and second gripping handles either inward or outward respectively against the resistance provided by the elastomeric band;

the user points outstretched arms vertically in an overhead direction and presses or pulls either set of the first and second gripping handles either inward or outward against the resistance provided by the elastomeric band;

the user points outstretched arms in front with the exerciser held out horizontally, parallel to the floor in front of the user and presses or pulls either set of the first and second gripping handles either inward or outward against the resistance provided by the elastomeric band;

the user holds the exerciser vertically over head and presses or pulls either set of the first and second gripping handles either inward or outward against the resistance provided by the elastomeric band;

the user points the exerciser downward toward the floor and presses or pulls either set of the first and second gripping handles either inward or outward against the resistance provided by the elastomeric band;

the user grips the exerciser and holds it behind the back of the user and presses or pulls either set of the first and second gripping handles either inward or outward against the resistance provided by the elastomeric band;

the user grips the exerciser and holds it in a manner either in front of, above, or behind the torso or head of the body of the user and presses or pulls either set of the first and second gripping handles either inward or outward against the resistance provided by the elastomeric band;

the user grips the exerciser and holds it in a manner perpendicular to the body of the user in such a fashion as to allow the user to pull one of the interconnected arms toward the body with the other interconnected arm of the exerciser having been braced against the body and against the resistance provided by the elastomeric band;

the user grips the exerciser and holds it in a manner with the exerciser lateral to one side of the body of the user with one of the interconnected arms being braced against the body in such a manner as to allow the other of the interconnected arms to be pulled toward the body in a lateral motion, against the resistance provided by the elastomeric band;

the user holds the first and second gripping handles at one end of the exerciser that can be laterally expanded outward, holds the exerciser with outstretched arms, and pushes the first and second gripping handles apart against the resistance provided by the elastomeric band;

the user grips the exerciser and holds the exerciser in a manner either in front of, above, or behind the torso or head of the body of the user and pulls the first and second gripping handles apart against the resistance provided by the elastomeric band;

the user sits in a sitting position and places the exerciser on the lap of the user with one of the first and second gripping handles pointing laterally outward toward either side of the body of the user, holds the exerciser with the other of the first and second gripping handles, and bends at the torso in the direction of one of the first and second gripping handles thereby compressing the first and second gripping handles together against the resistance provided by the elastomeric band;

the user sits in a sitting position and places the first and second gripping handles laterally compressed inward between the left and right thighs of the user, holds the exerciser with outstretched arms for stability, and compresses the first and second gripping handles inward together against the resistance provided by the elastomeric band;

the user holds the first and second gripping handles laterally compressed inward, and places the opposite ends of the first and second gripping handles firmly against the outside of the thighs of the user, and presses the first and second gripping handles outward against the resistance provided by the elastomeric band; and/or the user sits in a sitting position and places the exerciser on the lap of the user with one of the first and second gripping handles pointing laterally outward toward the side of the body, holding one of the first and second gripping handles that can be compressed downward and rotating one of user's arms downward such that the shoulder muscles of the user are stressed against the resistance provided by the elastomeric band.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

We claim the following:

1. A resistance-type exerciser comprising pivotally interconnected arms having a pair of more closely spaced handle forming ends and a pair of less closely spaced handle forming ends, the interconnected arms being coupled together by a pin mechanism providing a pivotal interconnection between the interconnected arms so as to provide two sets of functionally usable handles held in tension by an elastic resistance band formed as a continuous loop connected to the exerciser and being held in place through integral slots formed in the interconnected arms adjacent to the pin mechanism, wherein each slot is elongated and formed on a respective arm.

2. A resistance-type exerciser comprising pivotally interconnected arms having a pair of shorter more closely spaced handle forming ends and a pair of longer, less closely spaced handle forming ends, the interconnected arms being coupled together by a pin mechanism providing a pivotal interconnection between the interconnected arms so as to provide two sets of functionally usable handles held in tension by at least one elastic resistance band formed as a continuous loop received in integral slots in the pair of interconnected arms adjacent to the pin mechanism, wherein each slot is elongated and formed on a respective arm, the slots being configured for receiving a respective end of the at least one resistance band to thereby create tension in both interconnected arms, the handle forming ends being configured to be gripped by a user by which exercises can be performed by one of (i) forcing the shorter, more closely spaced handle forming ends of the exerciser apart in a tension causing exercise, (ii) forcing the longer, less closely spaced ends of the exerciser together in a compression causing exercise, (iii) forcing the shorter, more closely spaced handle forming ends of the exerciser in a compression causing exercise or (iv) forcing the longer, less closely spaced ends of the exerciser apart in a tension causing exercise.

3. The exerciser of claim 2 wherein the interconnected arms are held in tension by at least one replaceable elastic band of material formed as a continuous loop which causes the exerciser to maintain a closed condition with the shorter handle forming ends being forced apart and the longer handle forming ends being forced together as its normal resting state.

4. The exerciser of claim 2 wherein the interconnected arms are held in tension by at least one replaceable elastic band of material formed as a continuous loop which causes the exerciser to maintain a closed condition with the longer handle forming ends being forced apart and the shorter handle forming ends being forced together as its normal resting state.

5. A method of exercising using a resistance-type exerciser comprising pivotally interconnected arms having a pair of more closely spaced handle forming ends and a pair of less closely spaced handle forming ends, the interconnected arms being coupled together by a pin mechanism providing a pivotal interconnection between the interconnected arms so as to provide two sets of functionally usable handles held in tension by an elastic resistance band formed as a continuous loop received in integral slots in the pair of interconnected arms adjacent to the pin mechanism, wherein each slot is elongated and formed on a respective arm, the slots being configured for receiving a respective end of the resistance band to thereby create tension in both interconnected arms, comprising at least one of:

(a) providing first and second gripping handles pinned about an axis so as to facilitate lateral motion, each first and second gripping handle being configured to be compressed or moved toward one another by a user in an inward lateral motion against the resistance provided by the elastic band; or (b) providing first and second gripping handles pinned about an axis so as to facilitate lateral motion, each first and second gripping handle being configured to be extended or moved away from one another by a user in an outward lateral motion against the resistance provided by the elastic band; or (c) providing first and second gripping handles pinned about an axis so as to facilitate lateral motion, each first and second gripping handle being configured so as to be simultaneously moved in their respective inward or outward lateral motion by a user against the resistance provided by the elastic band thereby allowing for simultaneous use in both lateral directions of motion.

6. The method of claim 5 wherein step (a) includes the user holding the exerciser with outstretched arms, and pressing or pulling either set of the first and second gripping handles either inward or outward respectively against the resistance provided by the elastic band.

7. The method of claim 5 wherein step (a) includes the user pointing outstretched arms vertically in an overhead direction and pressing or pulling either set of the first and second gripping handles either inward or outward against the resistance provided by the elastic band.

8. The method of claim 5 wherein step (a) includes the user pointing outstretched arms in front with the exerciser held out horizontally, parallel to the floor in front of the user and pressing or pulling either set of the first and second gripping handles either inward or outward against the resistance provided by the elastic band.

9. The method of claim 5 wherein step (a) includes the user holding the exerciser vertically over head and pressing or pulling either set of the first and second gripping handles either inward or outward against the resistance provided by the elastic band.

10. The method of claim 5 wherein step (a) includes the user pointing the exerciser downward toward the floor and pressing or pulling either set of the first and second gripping handles either inward or outward against the resistance provided by the elastic band.

11. The method of claim 5 wherein step (a) includes the user gripping the exerciser and holding it behind the back of the user and pressing or pulling either set of the first and second gripping handles either inward or outward against the resistance provided by the elastic band.

12. The method of claim 5 wherein step (a) includes the user gripping the exerciser and holding it in a manner either in front of, above, or behind the torso or head of the body of the user and pressing or pulling either set of the first and second gripping handles either inward or outward against the resistance provided by the elastic band.

13. The method of claim 5 wherein step (a) includes the user gripping the exerciser and holding it in a manner perpendicular to the body of the user in such a fashion as to allow the user to pull one of the interconnected arms toward the body with the other interconnected arm of the exerciser having been braced against the body and against the resistance provided by the elastic band.

14. The method of claim 5 wherein step (a) includes the user gripping the exerciser and holding it in a manner with the exerciser lateral to one side of the body of the user with one of the interconnected arms being braced against the body in such a manner as to allow the other of the interconnected arms to be pulled toward the body in a lateral motion, against the resistance provided by the elastic band.

15. The method of claim 5 wherein step (b) includes the user holding the first and second gripping handles at one end of the exerciser that can be laterally expanded outward, holding the exerciser with outstretched arms, and pushing the first and second gripping handles apart against the resistance provided by the elastomeric band.

16. The method of claim 5 wherein step (b) includes the user gripping the exerciser and holding the exerciser in a manner either in front of, above, or behind the torso or head of the body of the user and pulling the first and second gripping handles apart against the resistance provided by the elastic band.

17. The method of claim 5 wherein step (a) includes the user in a sitting position and placing the exerciser on the lap of the user with one of the first and second gripping handles pointing laterally outward toward either side of the body of the user, holding the exerciser with the other of the first and second gripping handles, and bending at the torso in the direction of one of the first and second gripping handles thereby compressing the first and second gripping handles together against the resistance provided by the elastic band.

18. The method of claim 5 wherein step (a) includes the user in a sitting position and placing the first and second gripping handles laterally compressed inward between the left and right thighs of the user, holding the exerciser with outstretched arms for stability, and compressing the first and second gripping handles inward together against the resistance provided by the elastic band.

19. The method of claim 5 wherein step (a) includes the user holding the first and second gripping handles laterally compressed inward, and placing the opposite ends of the first and second gripping handles firmly against the outside of the thighs of the user, and pressing the first and second gripping handles outward against the resistance provided by the elastic band.

20. The method of claim 5 wherein step (b) includes the user in a sitting position and placing the exerciser on the lap of the user with one of the first and second gripping handles pointing laterally outward toward the side of the body, holding one of the first and second gripping handles that can be compressed downward and rotating one of user's arms downward such that the shoulder muscles of the user are stressed against the resistance provided by the elastic band.

* * * * *